US012636569B1

(12) United States Patent
Slagter

(10) Patent No.: US 12,636,569 B1
(45) Date of Patent: May 26, 2026

(54) SKATEBOARD AND SKATEBOARD TRUCKS

(71) Applicant: Mark Slagter, San Jose (CR)

(72) Inventor: Mark Slagter, San Jose (CR)

( * ) Notice: Subject to any disclaimer, the term of this patent is extended or adjusted under 35 U.S.C. 154(b) by 308 days.

(21) Appl. No.: 18/431,783

(22) Filed: Feb. 2, 2024

Related U.S. Application Data

(60) Provisional application No. 63/443,431, filed on Feb. 5, 2023.

(51) Int. Cl.
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS 6,182,987 B1 * 2/2001 Bryant ..... A63C 17/0093 280/11.28
6,367,819 B1 * 4/2002 Andersen ..... A63C 17/015 411/383
6,467,782 B1 * 10/2002 Smith ..... A63C 17/012 411/119
6,523,837 B2 * 2/2003 Kirkland ..... A63C 17/012 280/11.28
7,093,842 B2 * 8/2006 Chmelar ..... A63C 17/01 280/87.041
7,219,907 B2 * 5/2007 Chang ..... A63C 17/012 280/87.041
8,246,058 B2 * 8/2012 Wang ..... A63C 17/012 280/11.28
9,289,676 B2 * 3/2016 Docter ..... A63C 17/0093
10,238,952 B2 * 3/2019 Clos ..... A63C 17/012
10,335,667 B2 * 7/2019 Martinez Almansa ..... A63C 17/015
10,881,944 B2 * 1/2021 Su ..... B32B 7/022
11,318,364 B2 * 5/2022 Slagter ..... A63C 17/012
11,478,692 B2 * 10/2022 Su ..... A63C 17/0046
2004/0145142 A1 * 7/2004 Wang ..... A63C 17/012 280/87.042
2006/0226620 A1 * 10/2006 Cole ..... A63C 17/01 280/87.042
2013/0270781 A1 * 10/2013 Kuyt ..... A63C 17/012 280/11.27
2015/0061252 A1 * 3/2015 Lininger, Jr. ..... A63C 17/012 280/87.042

(Continued)

*Primary Examiner* — Erez Gurari
(74) *Attorney, Agent, or Firm* — Fitch, Even, Tabin & Flannery LLP

(57) ABSTRACT

A truck suitable is described herein that is suitable for attachment to a skateboard, the truck including: a kingpin having a shaft with a first end portion and a second end portion; an elastic bushing having a hub with a plurality of outwardly-extending spokes, the hub having an opening for receiving the shaft of the kingpin; a baseplate having an opening for receiving the first end portion of the kingpin, the baseplate; a first undulating surface fixed relative to the baseplate and facing the elastic bushing for seating the elastic bushing; a hanger having an opening for receiving the second end portion of the kingpin; and a second undulating surface fixed relative to the hanger and facing the elastic bushing for seating the elastic bushing; wherein hanger is pivotable relative to the baseplate about the kingpin.

20 Claims, 9 Drawing Sheets

(56) References Cited

U.S. PATENT DOCUMENTS

2023/0372807 A1* 11/2023 Iraola Garmendia .....
A63C 17/015

* cited by examiner

SKATEBOARD AND SKATEBOARD TRUCKS

CROSS-REFERENCE TO RELATED APPLICATION

This application claims the benefit of U.S. Appl. No. 63/443,431, filed Feb. 5, 2023, which is hereby incorporated by reference in its entirety.

FIELD

Boards, such as skateboards and mechanisms, specifically trucks, used in boards or skateboards are described herein.

BACKGROUND

The sport of skateboarding first started when surfers took the trucks and wheels off of roller-skates and screwed them to a piece of plywood to try to simulate surfing on pavement, even though the surfaces of water and pavement are very different. A surfboard has curvature to the bottom plane called rocker and shaped side rails. The rider carves through the water by balancing properly above the surfboard, tilting over the surfboard submerging the rail into the water, and allowing the rocker to create the arc of a turn. The fin/fins of a surfboard, which are located towards the back bottom side where there is less rocker, help to keep the board from skipping on top of the water. By shifting weight front to back and side to side, the surfer is able to turn, accelerate and stall the surfboard control his position in the water.

Conventional skateboards and skateboard truck mechanisms crudely simulated surfing. By tilting the skateboard deck in a similar fashion as surfing, the rider is able to turn the front wheels in the direction of the "tilt" and the back wheels in the opposite direction, thusly carving a more regularly arc shaped path along the pavement. Conventional skateboard trucks provide a mechanism that can be tightened or loosened, which results in the skateboard requiring more or less effort to turn.

The original design of the skateboard truck has changed very little over the last 50 years. Most of the tricks that skateboarders perform and competitive disciplines of skateboarding have grown and evolved using this original truck design. More recently a trend in skateboarding called "surf skating" has arisen that is focused on carving and self-propelling to simulating surfing. A few recent inventions such as the Carver, the Gullwing, the Rojas, the Revenge and many others have developed skateboard trucks that allow greater mobility. Many of the newer designs utilize different types of mechanisms, springs, bushing configurations, swing arms and greased metal bearings which allow them to have a freer and smoother movement. Most of these designs have a different front and back truck, with the front truck having a much tighter turning radius which facilitates easier self-propelling. Even though these more recent trends have developed boards that are far more efficient at self-propelling and generating speed of flat surfaces, they are overly complicated, top heavy, unstable, less durable, less able to perform tricks or perform well in bowls, turn more erratically and act very differently when going in reverse than they do going forward, hindering one's ability to do a large variety of standard skateboarding tricks.

The original skateboard truck design that has been around for decades (with only slight modifications) is still the most preferred by customers and outsells all of these new designs by a magnitude of 200:1, which is due to its simplicity, durability and ability to perform under the extreme competitive conditions (skateboarding is now an Olympic sport). This original truck consists of nine basic parts: the baseplate, the kingpin bolt, the rubber pivot cup, the axle hanger, two cylindrical or conical polyurethane bushings, two steel washers and steel/nylon locking nut. The hanger connects to the baseplate at two locations, the first is at the pivot point/pivot cup at the front, and the second is where the axle hanger is sandwiched between two polyurethane bushings at the back. The two endpoints described are at roughly a 45 degree angle, so as the axle swings outward relative to the tilting board, the wheels change direction. As the axle changes direction it also compresses the cylindrical bushings seated in the axle hanger. The two bushings can be tightened or loosened with the steel/nylon lock nut for greater or lesser mobility. Although there is some degree of adjustability (which can also be effected by changing out the bushings to a polyurethane with a higher or lower durometer) they mechanism is sloppy at a looser setting and has an uneven resistance when the teeter tottering of the axle approaches its limit (or the hanger makes contact at the kingbolt, often damaging the aluminum and causing the kingpin to become loose). The cylindrical polyurethane bushings used in the original skateboard truck design are compressed primarily at two outer edges, at times to less than 15 percent of their volume which can cause severe damage and splitting. The rubber pivot cup is also problematic for many reasons: it has a limited ability to absorb vertical forces, wears out quickly and must often be replaced to avoid aluminum to aluminum contact which can permanently damage the skateboard truck.

SUMMARY

A truck suitable is described herein that is suitable for attachment to a skateboard, the truck including: a kingpin having a shaft with a first end portion and a second end portion; an elastic bushing having a hub with a plurality of outwardly-extending spokes, the hub having an opening for receiving the shaft of the kingpin; a baseplate having an opening for receiving the first end portion of the kingpin, the baseplate; a first undulating surface fixed relative to the baseplate and facing the elastic bushing for seating the elastic bushing; a hanger having an opening for receiving the second end portion of the kingpin; and a second undulating surface fixed relative to the hanger and facing the elastic bushing for seating the elastic bushing; wherein hanger is pivotable relative to the baseplate about the kingpin.

The truck is described that that consists of undulating surfaces and a highly adjustable "hub and spoke" shaped polyurethane elastic bushing therebetween that acts as both a bearing and an oscillating spring to provide improved spring, load bearing and suspension for a smoother and more enjoyable high performance skateboard riding experience.

In some aspects, the first undulating surface has a series of grooves that correspond to the number of spokes of the elastic bushing.

In some aspects, the second undulating surface has a series of grooves that correspond to the number of spokes of the elastic bushing.

In some aspects, the elastic bushing has between three and six spokes.

In some aspects, the spokes are equally spaced about the hub.

In some aspects, the spokes have a circular cross-section.

In some aspects, the first undulating surface is generally disc-shaped and is integrally formed with the baseplate.

In some aspects, the second undulating surface is generally disc-shaped and is integrally formed with the hanger.

In some aspects, the first undulating surface has a first undulating surface opening for receiving the shaft of the kingpin; and the second undulating surface has a second undulating surface opening for receiving the shaft of the kingpin.

In some aspects, at least a part of the second end portion of the kingpin includes threading; and wherein a nut is threaded onto the threading to compress the elastic bushing between the first undulating surface and the second undulating surface.

In some aspects, the kingpin is the sole pivot of the hanger relative to the baseplate.

In some aspects, the techniques described herein relate to a truck, further including: an additional elastic bushing having a hub with a plurality of outwardly-extending spokes, the hub having an opening for receiving the shaft of the kingpin; a third undulating surface, opposite the second undulating surface and fixed relative thereto for seating the additional plastic bushing; a fourth undulating surface for seating the additional plastic bushing.

In some aspects, the second undulating surface and the third undulating surface are integrally formed.

In some aspects, the third undulating surface has a series of grooves that correspond to the number of spokes of the additional elastic bushing; and wherein the fourth undulating surface has a series of grooves that correspond to the number of spokes of the additional elastic bushing.

In some aspects, the additional elastic bushing has between three and six spokes equally spaced about the hub.

In some aspects, the spokes have a circular cross-section.

In some aspects, the techniques described herein relate to a skateboard having any one of the trucks described herein and, optionally, two of the trucks.

In some aspects, spokes of the elastic bushing can twist to a greater extent further from the hub as compared to closer to the hub.

Any of the foregoing aspects can be combined as may be suitable.

The skateboard truck that not only performs similar to the original skateboard truck design in its ability to do flip tricks and perform in bowls (disciplines of Street Skating, Transition Skating and Downhill Skating), but is smoother and easier to self-propel as well. The skateboard truck that is simple in its design and has less parts than the original skateboard truck, while avoiding using heavy or less durable and high maintenance parts that can increase their weight, decrease their stability and heighten their center of gravity as found in many of the new designs. The bushing system that has a far greater range of adjustability to create an oscillating rotation for different weight and force and can be a long lasting bushing system that is not overly compressed and easily degraded.

DETAILED DESCRIPTION

Figure 1:
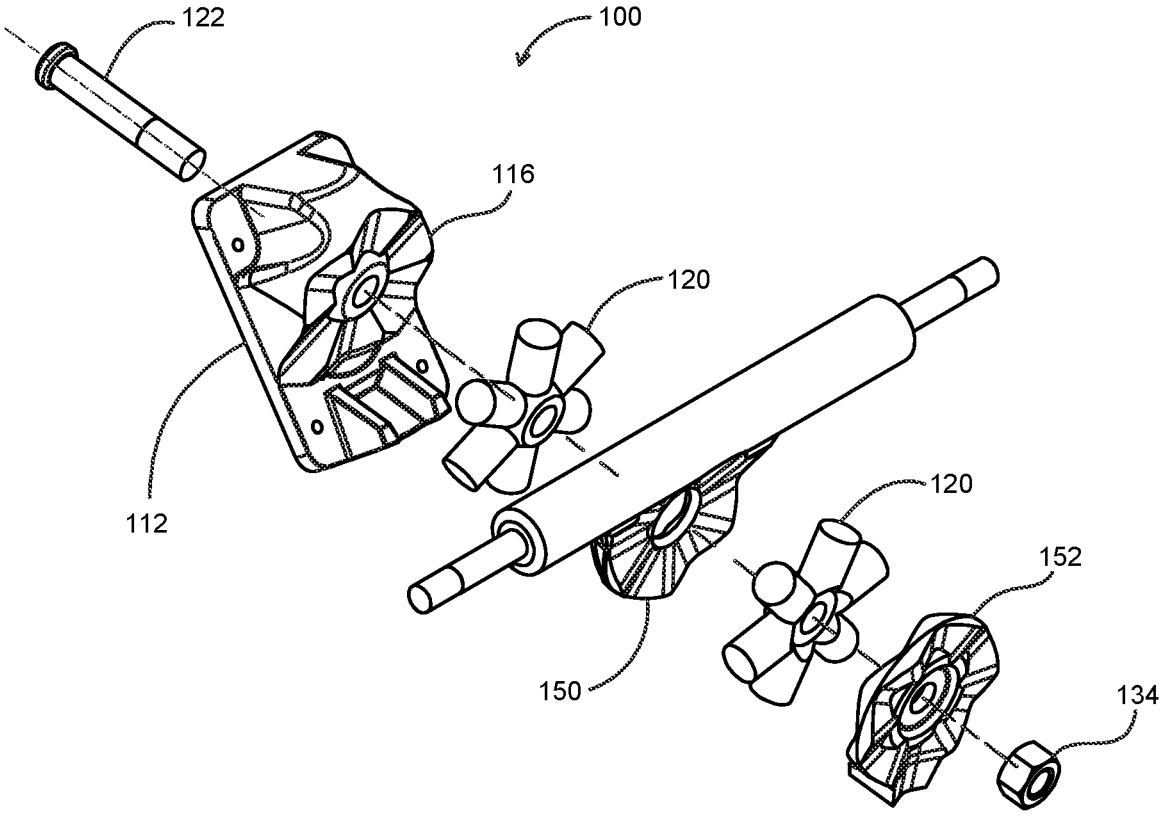
FIG. 1 is an exploded view of a truck in accordance with a first embodiment, showing a baseplate, a first undulating surface, a second undulating surface, an elastic bushing between the first and second undulating surfaces, a third undulating surface, a fourth undulating surface, an additional elastic bushing between the third and fourth undulating surfaces, and a kingpin.

Described herein and, in various aspects, depicted in FIGS. 1-15 are trucks suitable for attachment to a skateboard or other wheeled board. The truck includes a kingpin having a shaft with a first end portion and a second end portion; an elastic bushing having a hub with a plurality of outwardly-extending spokes, the hub having an opening for receiving the shaft of the kingpin; a baseplate having an opening for receiving the first end portion of the kingpin, the baseplate; a first undulating surface fixed relative to the baseplate and facing the elastic bushing for seating the elastic bushing; a hanger having an opening for receiving the second end portion of the kingpin; and a second undulating surface fixed relative to the hanger and facing the elastic bushing for seating the elastic bushing; wherein hanger is pivotable relative to the baseplate about the kingpin. In a first embodiment, depicted in FIGS. 4A-7, the truck includes a single one of the elastic bushings having the hub and spokes. In a second embodiment, depicted in FIGS. 1-3, the truck includes an additional one of the elastic bushings having the hub and spokes. Skateboards having the trucks described herein are depicted in FIGS. 8-15.

As shown in the first embodiment of FIGS. 4A-7, the first embodiment of the truck 10 includes a baseplate 12, a hanger 14, a first undulating surface 16 and a second undulating surface 18. The first undulating surface 16 is integrally formed with the baseplate 12, although it could also be a separate structure. The first undulating surface 16 is preferably, though not necessarily, fixed relative to the baseplate 12. Likewise, the second undulating surface 18 is integrally formed with the hanger 14, although it, too, could also be a separate structure. The second undulating surface 18 is preferably, though not necessarily, fixed relative to the hanger 14. An elastic bushing 20 is seated between the first undulating surface 16 and the second undulating surface 18. A kingpin 22 is used to clamp these structures together.

More specifically, the kingpin 22 extends through an opening 24 in the baseplate 12 and the first undulating surface 16 (which, as shown in the exemplary embodiment, is integral with the baseplate 12), an opening 26 in the elastic bushing, and an opening 28 in the second undulating surface 18 and the hanger 14 (which, as shown in the exemplary embodiment, is integral with the second undulating surface 18). The kingpin 22 may be a bolt having a head 30 and a shaft 32. The shaft 32 can have a first end portion adjacent the head 30 and a second end portion adjacent a free end of the shaft 32, opposite the head 30. A threading may be on the second end portion of the shaft 32. When assembled, the head 30 of the kingpin 22 can be disposed on an opposite side of the first undulating surface 16 as compared to the elastic bushing 20. A threaded nut 34 can be secured to the threading and tightened to compress the elastic bushing 20 between the first undulating surface 16 and the second undulating surface 18 and thereby pivotably clamp the hanger 14 relative to the baseplate 12. One or more washers bushings, cap plates or the like can be positioned between the hanger 14 and the nut 34. As shown, a bearing 38 (which can be of or include a low-friction materials such as Teflon) is positioned between the hanger 14 and a steel washer 36, on an opposite side of the washer 36 compared to the nut 34 to facilitate rotation. When the baseplate 12 is attached to the board 40 of a skateboard (see FIGS. 8-15), such as via screws inserted through openings in the baseplate (four are shown, but the number can differ), the hanger 14 can then pivot relative to the baseplate 12, and thus the board 40, about the kingpin 22. The nut 34, which can have a nylon insert, can be tightened to compress the elastic bushing 20 to the desired amount. The kingpin 22 can be made of steel and can optionally be machine pressed into a ⅜" center opening in the first undulating surface 16 of the baseplate 12.

Figure 7:
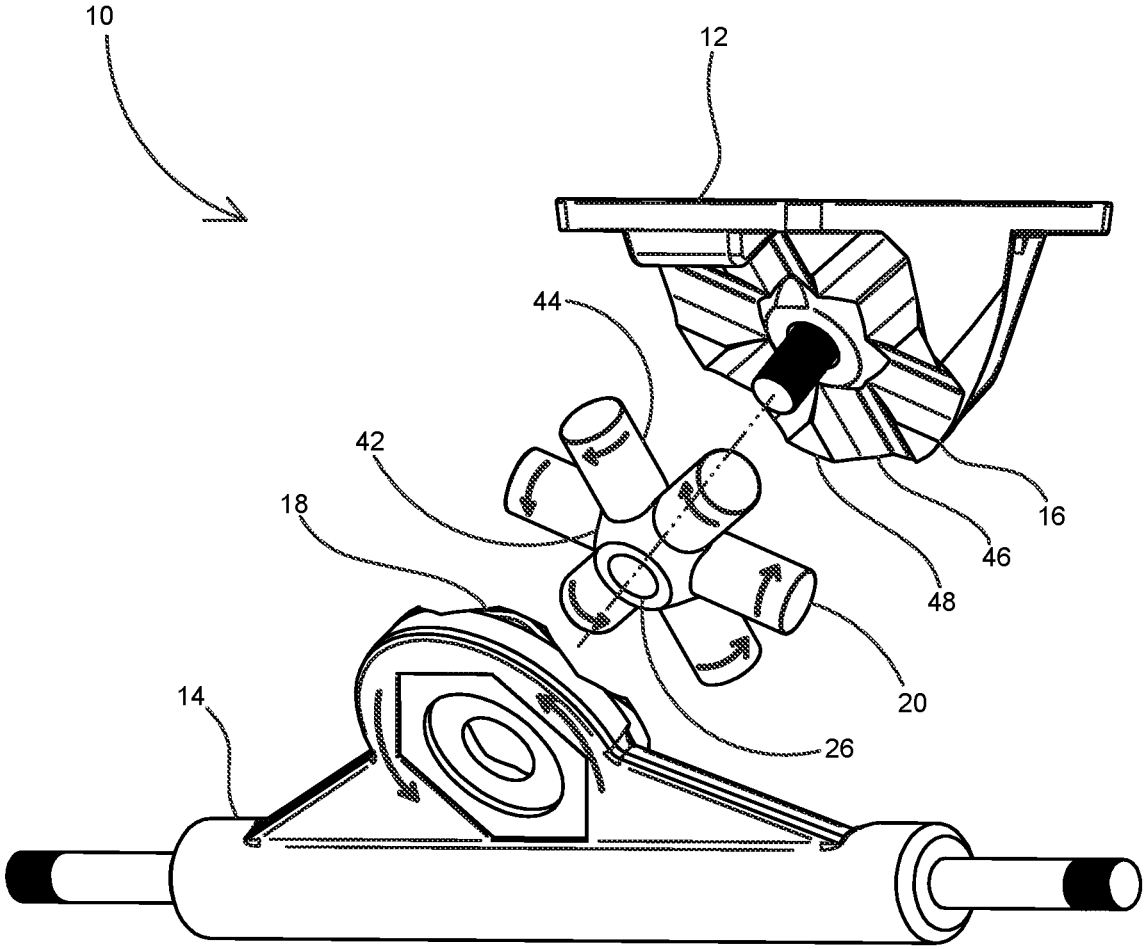
FIG. 7 is a partially exploded view of the truck of FIG. 5, showing spokes of the elastic bushing twisting clockwise in response to the hanger twisting counter-clockwise.
Figure 8:
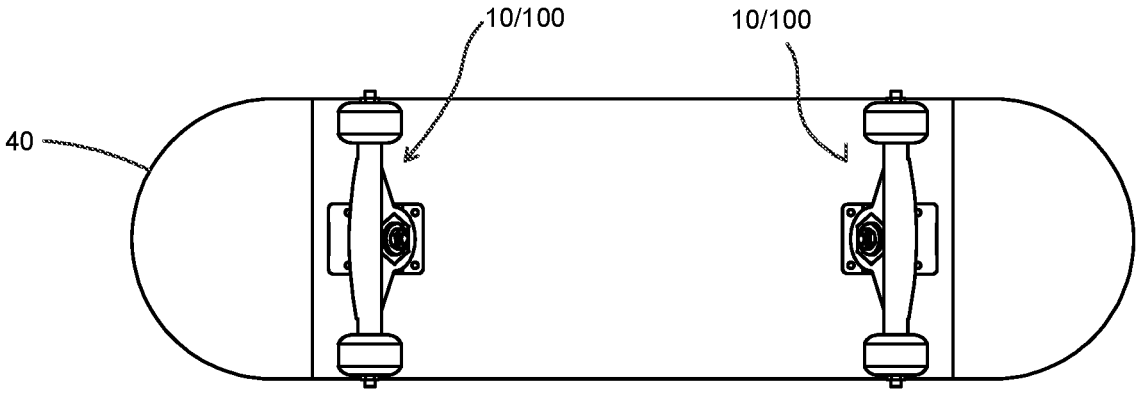
FIG. 8 is a bottom plan view of a skateboard incorporating the trucks of either the first or second embodiments.
Figure 9:
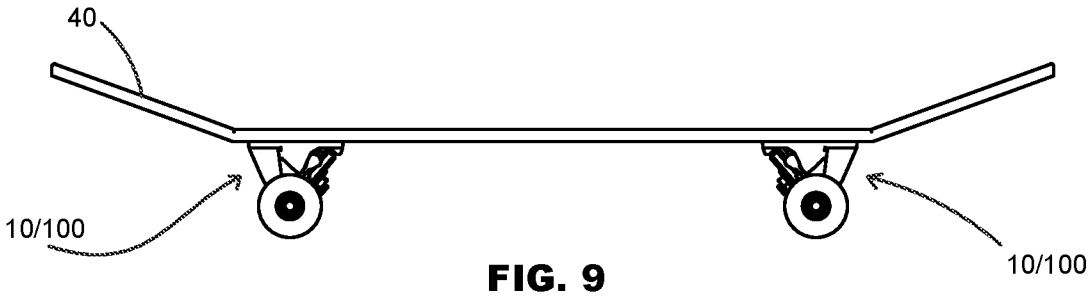
FIG. 9 is a side elevation view of the skateboard of FIG. 8.
Figure 10:
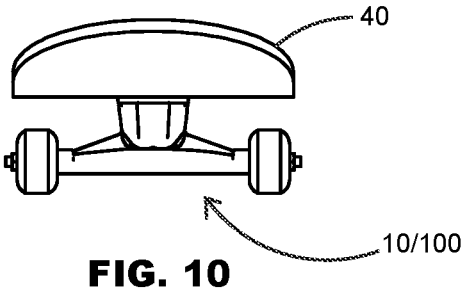
FIG. 10 is a front end view of the skateboard of FIG. 8.
Figure 11:
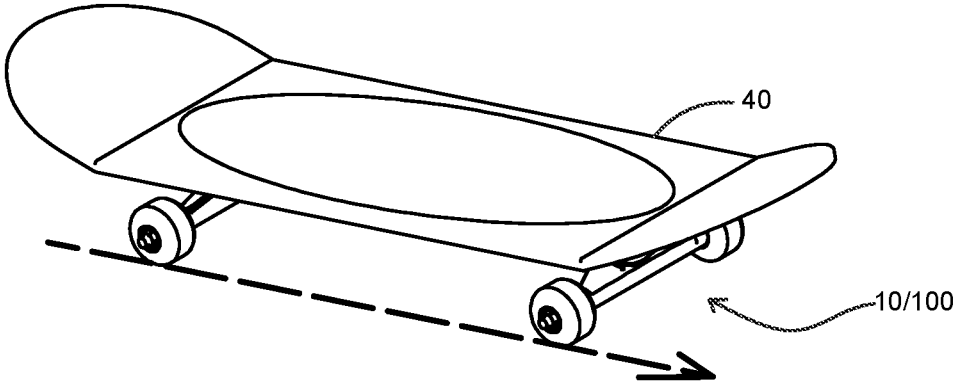
FIG. 11 is a perspective view of the skateboard of FIG. 8 rolling forward.
Figure 12:
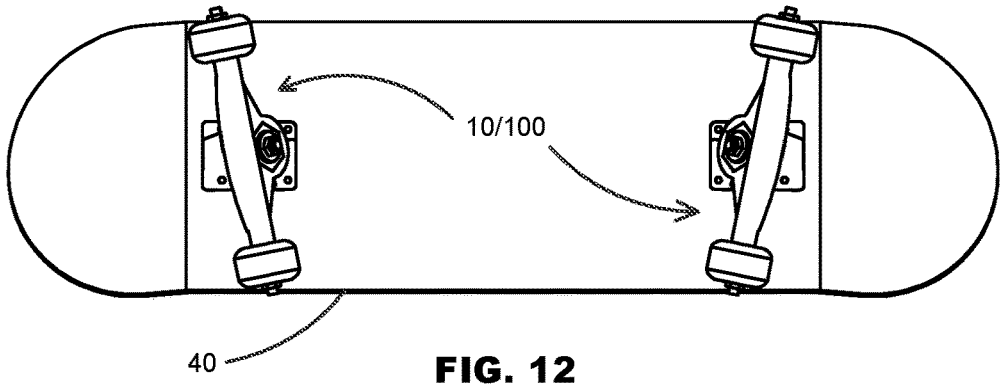
FIG. 12 is a bottom plan view of the skateboard of FIG. 8 turning counter-clockwise.
Figure 13:
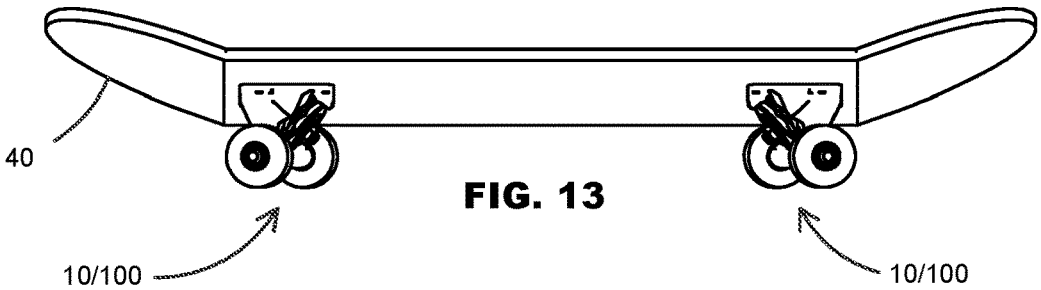
FIG. 13 is a side elevation view of the skateboard of FIG. 8 turning counter-clockwise.
Figure 14:
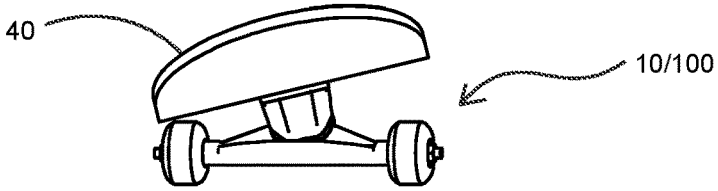
FIG. 14 is a front end view of the skateboard of FIG. 8 turning counter-clockwise.
Figure 15:
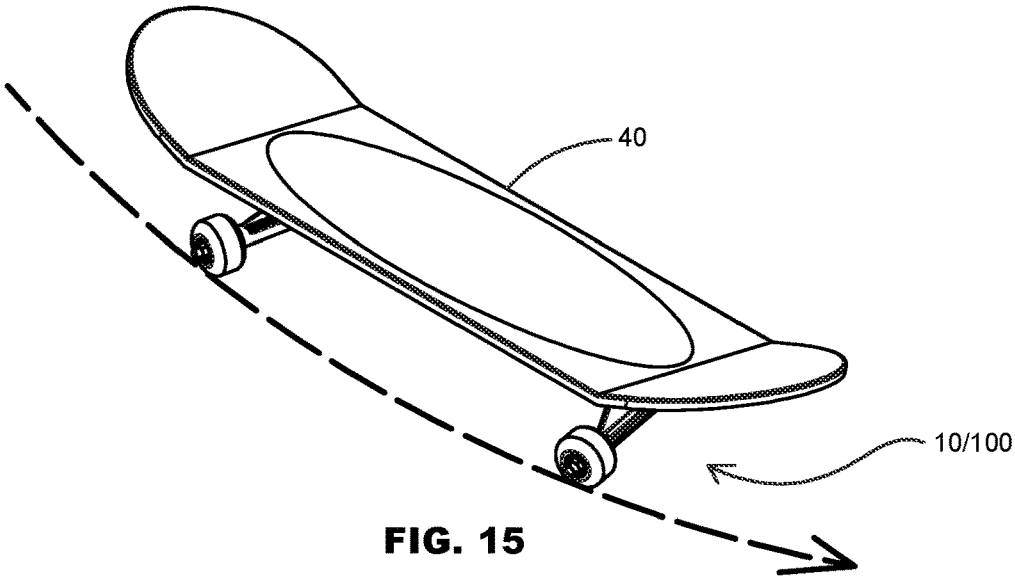
FIG. 15 is a perspective view of the skateboard of FIG. 8 turning counter-clockwise.

The elastic bushing 20 has a central hub 42 and a plurality of spokes 44 extending radially outward from the hub 42, as shown in FIG. 7. Each of the spokes 44 is attached to the hub 42 (preferably, though not necessarily, integrally formed therewith) and has a free end opposite the hub 42 and radially outward from the hub 42. As shown, the elastic bushing 20 has six spokes 44; however, other numbers of spokes can be equally suitable, e.g., between 3-6, 3, 4, 5, 6 and beyond. The spokes 44 each have a circular cross-section, although other shapes, such as ovular, also may be suitable.

The first and second undulating surfaces 16, 18 are shown as being identical, but they do not have to be. The undulating surfaces 16, 18 each include a series of radially extending grooves 46 separated by ridges 48. The groves 46 are preferably of constant shape in the radial direction, at least in part; thus, the ridges 48 can be pie-shaped. The bottoms of the grooves 46, in a circumferential extent, are preferably not circular but rather are about a half a pointed oval, although other shapes and curved shapes can be used.

When the truck 10 is assembled, the kingpin 22, the baseplate 12, the cap piece and the nut 34 always maintain in a fixed position. A mentioned, the nut 34 can be loosened or tightened to the proper adjustment for different riding conditions or preferences. The hanger 12 has a pair of axels, which can be 5/16" steel or aluminum, for receiving wheels, as shown in FIGS. 8-15.

Once the skateboard is completely assembled and in use, the tilting over of the skateboard deck 40, by a rider, forces the hanger 14 to rotate about the kingpin 22 relative to the baseplate 12. The hanger 14 rotates smoothly between the spokes 44 of the elastic bushing 20. More specifically, one function of the spokes or legs 44 of the elastic bushing 20 is to allow the hanger 14 to rotate smoothly as the second undulating surface 18, which can be disc shaped, rotates relative to the first undulating surface 16, which also can be disc shaped. Another function of the spokes or legs 44 of the elastic bushing 20 is to create a spring-action caused by the rolling of the spokes 44 as constrained by their respective grooves 46 into which they are seated. The spokes 44 are fixed towards the center by the hub 42, which causes a twisting to torque the spokes 44, which can be formed of polyurethane (this twisting is shown by the arrows in FIG. 7, and the twisting is greater the further from the hub 42). Additional spring force is created when the grooves or valleys 46 and ridges 48 of the undulating surfaces gradually compress the spokes 44 of the elastic bushing 20 more and more as the rotation increases about the kingpin 22. These forces that deform, twist and compress the polyurethane bushing create spring and recoil in the bushings 20 as they naturally want to return to their original shape.

The spokes 44 of the elastic bushing 22 that radiate outward from the center or hub 42 and the core which compresses into the center hole of the hanger 14 keep the hanger 14 centered in relationship to the kingpin 22, baseplate 12 and optional cap piece, thus preventing contact between the hanger 14 and the kingpin 22 to prevent any leveraging or loosening of the kingpin 22 where it is pressure fit, or otherwise secured, into the hole of the baseplate 12. The elastic bushing 20 keeps the undulating surfaces 16, 18 apart, preferably by a little over ⅛" apart and even thought the primary movement of the hanger 14 is rotational, the elastic bushing 20 can absorb vibration from irregularities in the riding surfaces, such as in a more axial direction or tilted direction relative to the shaft 32 of the kingpin 22. The grooves 46 and ridges 48 of the first undulating surface 16 and the second undulating surface 18 rotate relatively to compress the elastic bushing 20, and optionally so that the maximum amount of compression occurs just prior to the point at which the skateboard wheels make contact with the skateboard deck 40, helping to eliminate wheel bite. As mentioned above, the six spokes 44 of the elastic bushing 20 and the matching number of grooves 46 in the first undulating surface 16 and the matching number of grooves 46 in the second undulating surface 18 is only by example, and other matched numbers of spokes 44 and grooves 46 can be utilized. While in the neutral position, the spokes 44 of the elastic bushing 20 sit in the deeper part of the grooves 46 of the undulating discs 16, 18 fixed relative to the baseplate 12 and the hanger 14. Since the spokes 44 are connected with the center hub 42, the rotation of the hanger 14 (with its undulating surface 18 with grooves 46) relative to the baseplate 12 (with its own undulating surface 16 with grooves 46) causes the spokes 44 to twist more at their ends than adjacent where they are attached to the hub 42 creating torsion in each individual spoke or rod 44. As the grooves or valleys 46 rotate in relation to each other they not only cause the spokes 44 to roll and twist, but the angled walls of the grooves 46 begin to compress and deform the spokes 44 into increasingly flattened oval shapes the further they get from the center. These forces that roll, twist and compress the elastic bushings 20 create spring and recoil in the bushings 20 as they naturally want to return to their original shape and the hanger 14 to its original neutral position (but preferably do not overly compress, overly disfigure or overly degrade the polyurethane as associated with a conventional skateboard bushing).

The spokes 44 of this "hub and spoke" elastic bushing 20 radiate outward from the center hub 42 and sit in the corresponding grooves 46 of the undulating surfaces 16, 18 of the baseplate 12 and axle hanger 14 when in the neutral position. In this configuration the legs 44 (and corresponding grooves 46) are aligned perpendicular (e.g., +/−5 degrees, 10 degrees, 15 degrees) to the axis of rotation about the kingpin 22, which is entirely different from a conventional rubber spring configuration where the spring members are generally parallel to the axis of rotation.

The particular shape of the grooves 46 of the undulating surfaces 16, 18 can be varied from that shown to an ideal or preferred form to create desired resistance as well as limiting (or stopping) the amount of rotation at the point where the skateboard wheels are about to make contact with the skateboard deck 40, helping to eliminate wheel bite. Moreover, the grooves 46 do not have to be identical, nor do the spokes 44.

Figure 2:
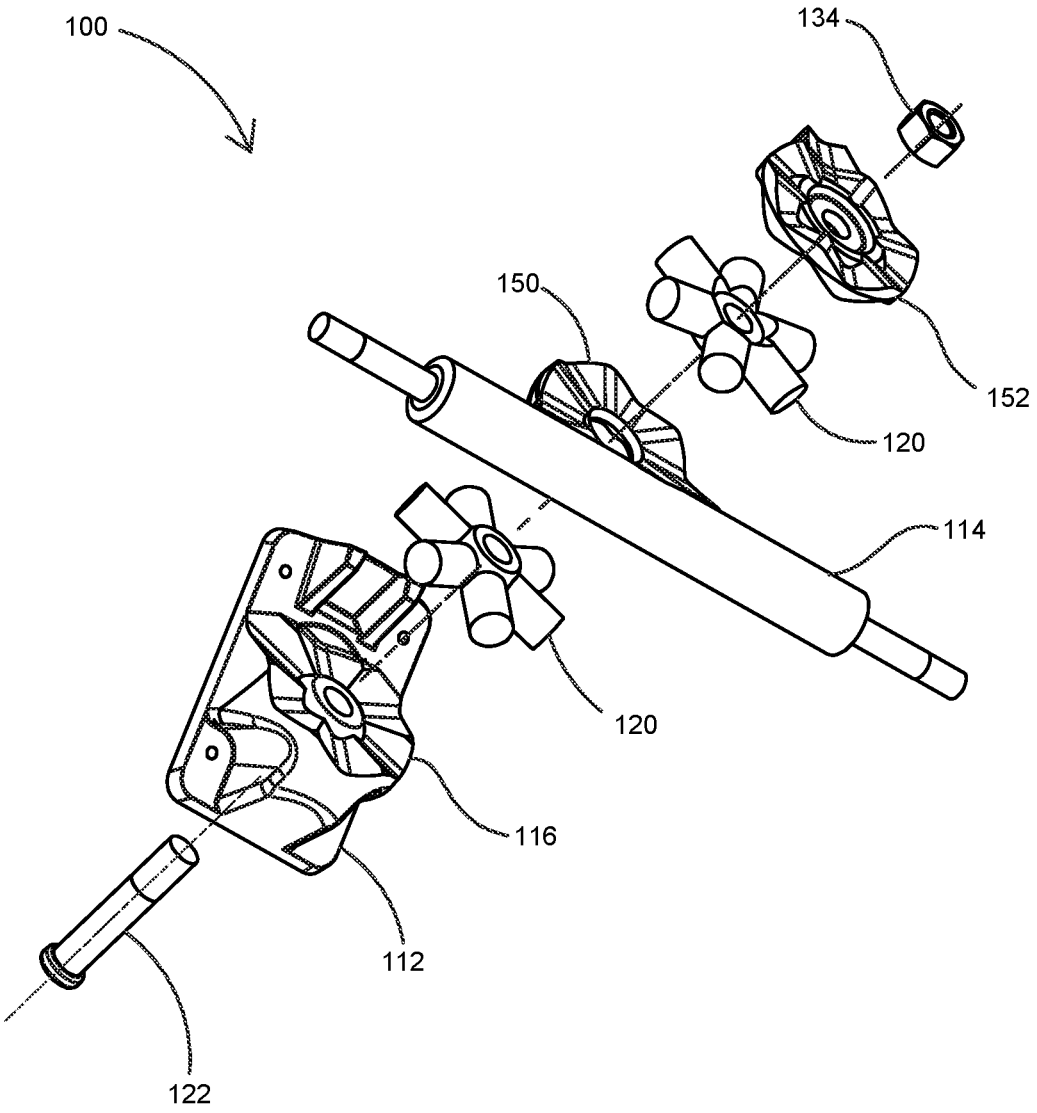
FIG. 2 is another exploded view of the truck of FIG. 1.
Figure 3:
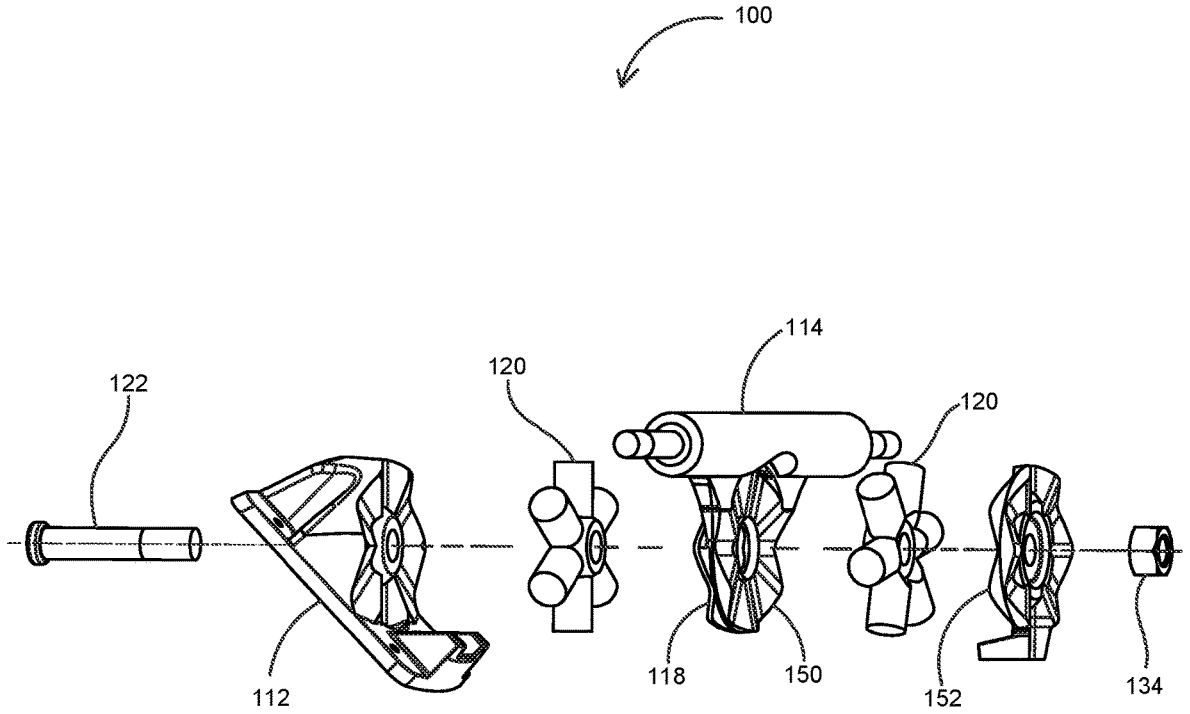
FIG. 3 is another exploded view of the truck of FIG. 1.
Figure 4B:
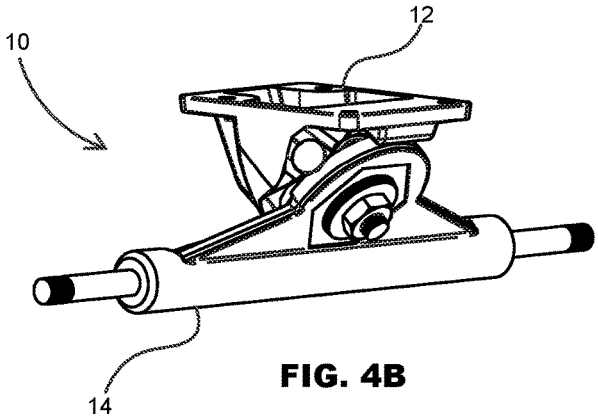
FIGS. 4A-4E are various perspective views of the assembled truck of FIG. 1.
Figure 4D:
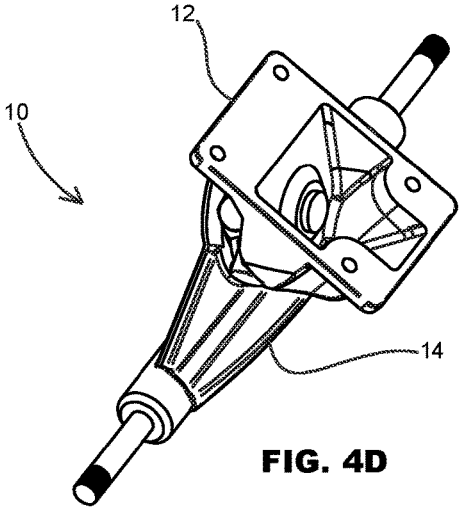
Figure 4A:
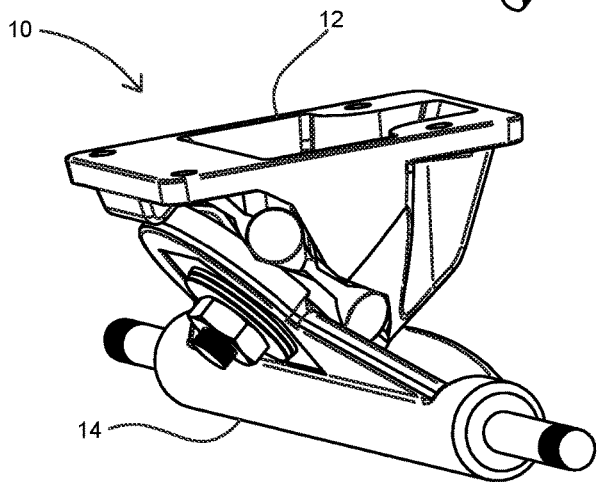
Figure 4C:
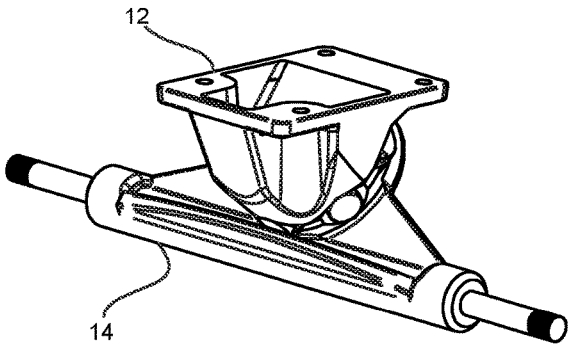
Figure 4E:
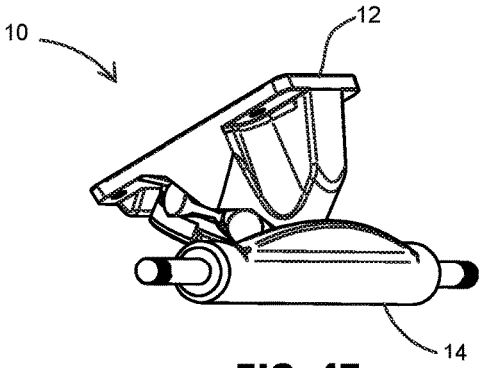
Figure 5:
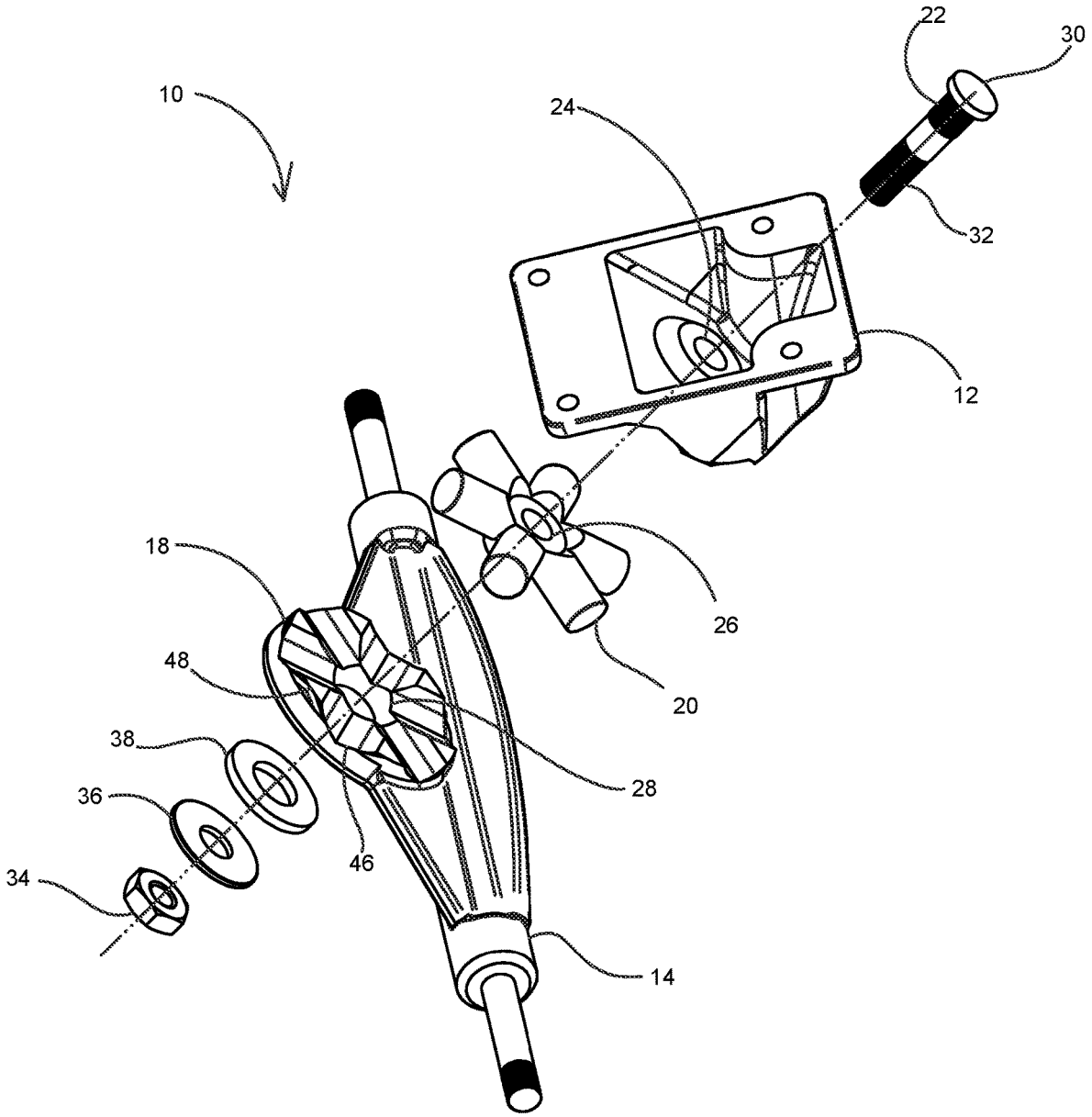
FIG. 5 is an exploded view of a truck in accordance with a second embodiment, showing a baseplate, a first undulating surface, a second undulating surface, an elastic bushing between the first and second undulating surfaces, and a kingpin.
Figure 6:
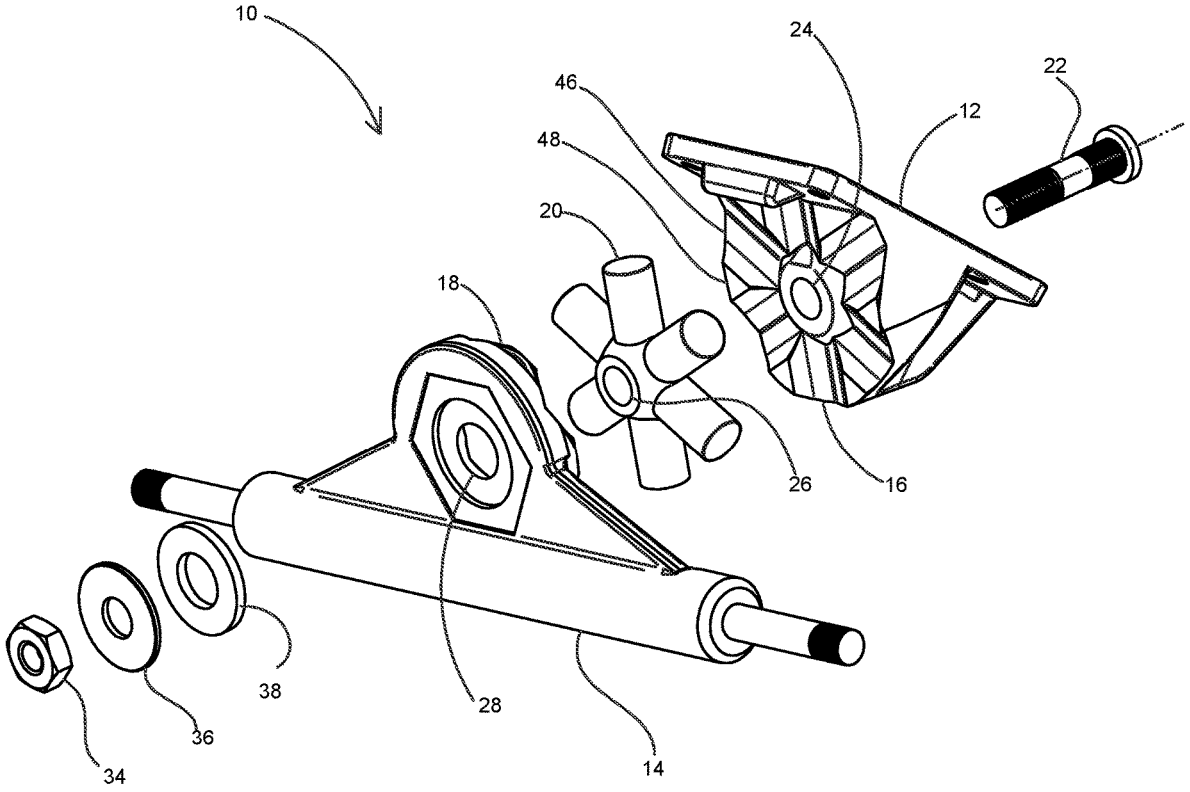
FIG. 6 is another exploded view of the truck of FIG. 5.

In the second embodiment of a truck 100, shown in FIGS. 1-3 (where similar parts have a "1" proceeding the reference number as compared to the truck 10 of the first embodiment), in addition to the first undulating surface 116, second undulating surface 118, and intermediate elastic bushing 120, there is an additional elastic bushing 120 seated between a third undulating surface 150 and a fourth undulating surface 152. The third undulating surface 150 is fixed relative to the second undulating surface 118, such as by being integral therewith. Each of third undulating surface 150 and fourth undulating surface 152 are generally disc shaped (although other shapes can be used), and have an opening for receiving the shaft of the kingpin 122. The additional elastic bushing 120 also has an opening for receiving the shaft of the kingpin 122. The nut 134 is positioned on an opposite side of the fourth undulating surface 152 as compared to the additional elastic bushing 120. The third undulating surface 150 and the fourth undulating surface 152, as well as the additional elastic bushing 120, can be constructed similarly to the first undulating surface 116, second undulating surface 118 and elastic bushing 120 therebetween described above with respect to the first embodiment of the truck 10. They can be identical in terms of the number of grooves and spokes, or they can differ.

The trucks 10/100 of either the first embodiment or second embodiment are attached to the board or deck 40 to form the skateboard, as shown in FIG. 8-15. FIGS. 8-11 show the skateboard with the trucks 10/100 in a neutral position for rolling straight. FIGS. 12-15 show the skateboard with weight having been applied to the left side such that the skateboard rolls to the left, it being understood that the skateboard can similarly roll to the right when weight is applied to the right side.

The invention claimed is:

1. A truck suitable for attachment to a skateboard, the truck comprising:

a kingpin having a shaft with a first end portion and a second end portion;

an elastic bushing having a hub with a plurality of outwardly-extending spokes, the hub having an opening for receiving the shaft of the kingpin;

a baseplate having an opening for receiving the first end portion of the kingpin;

a first undulating surface fixed relative to the baseplate and facing the elastic bushing for seating the elastic bushing;

a hanger having an opening for receiving the second end portion of the kingpin; and a second undulating surface facing the elastic bushing for seating the elastic bushing;

wherein hanger is pivotable relative to the baseplate about the kingpin.

2. The truck of claim 1, wherein the first undulating surface has a series of grooves that correspond to the number of spokes of the elastic bushing.

3. The truck of claim 2, wherein the second undulating surface has a series of grooves that correspond to the number of spokes of the elastic bushing.

4. The truck of claim 3, wherein the elastic bushing has between three and six spokes.

5. The truck of claim 4, wherein the spokes are equally spaced about the hub.

6. The truck of claim 5, wherein the spokes have a circular cross-section.

7. The truck of claim 1, wherein the first undulating surface is generally disc-shaped and is integrally formed with the baseplate.

8. The truck of claim 7, wherein the second undulating surface is generally disc-shaped and is integrally formed with the hanger.

9. The truck of claim 1, wherein the first undulating surface has a first undulating surface opening for receiving the shaft of the kingpin; and the second undulating surface has a second undulating surface opening for receiving the shaft of the kingpin.

10. The truck of claim 9, wherein at least a part of the second end portion of the kingpin includes threading; and wherein a nut is threaded onto the threading to compress the elastic bushing between the first undulating surface and the second undulating surface.

11. The truck of claim 1, wherein the kingpin is the sole pivot of the hanger relative to the baseplate.

12. The truck of claim 1, further comprising:

an additional elastic bushing having a hub with a plurality of outwardly-extending spokes, the hub having an opening for receiving the shaft of the kingpin;

a third undulating surface, opposite the second undulating surface and fixed relative thereto for seating the additional plastic bushing;

a fourth undulating surface for seating the additional elastic bushing.

13. The truck of claim 12, wherein the second undulating surface and the third undulating surface are integrally formed.

14. The truck of claim 12, wherein the third undulating surface has a series of grooves that correspond to the number of spokes of the additional elastic bushing; and wherein the fourth undulating surface has a series of grooves that correspond to the number of spokes of the additional elastic bushing.

15. The truck of claim 14, wherein the additional elastic bushing has between three and six spokes equally spaced about the hub.

16. The truck of claim 15, wherein the spokes have a circular cross-section.

17. A skateboard having the truck of claim 1.

18. A skateboard having two of the trucks of claim 1.

19. A skateboard having the truck of claim 12.

20. A skateboard having two of the trucks of claim 12.

* * * * *